US009323185B2

(12) United States Patent
Ohnishi

(10) Patent No.: US 9,323,185 B2
(45) Date of Patent: Apr. 26, 2016

(54) IMAGE FORMING APPARATUS HAVING HEATING UNIT HEATING RECORDING MATERIAL, PRESSURIZING UNIT FORMING A NIP BETWEEN ITSELF AND HEATING UNIT, AND CONTROL UNIT

(71) Applicant: CANON FINETECH INC., Saitama (JP)

(72) Inventor: Takahiro Ohnishi, Kashiwa (JP)

(73) Assignee: Canon Finetech Inc., Saitama (JP)

( * ) Notice: Subject to any disclaimer, the term of this patent is extended or adjusted under 35 U.S.C. 154(b) by 0 days.

(21) Appl. No.: 14/662,501

(22) Filed: Mar. 19, 2015

(65) Prior Publication Data

US 2015/0277310 A1 Oct. 1, 2015

(30) Foreign Application Priority Data

Mar. 25, 2014 (JP) ..... 2014-061674

(51) Int. Cl.
*G03G 15/20* (2006.01)

(52) U.S. Cl.
CPC .... *G03G 15/2017* (2013.01); *G03G 2215/2035* (2013.01)

(58) Field of Classification Search
CPC ..... G03G 15/2053; G03G 15/2017
See application file for complete search history.

(56) References Cited

U.S. PATENT DOCUMENTS

2004/0042827 A1* 3/2004 Izawa ..... G03G 15/2064 399/328
2013/0164060 A1* 6/2013 Honke ..... G03G 15/2057 399/333
2014/0003846 A1 1/2014 Ohnishi
2015/0153691 A1* 6/2015 Ono ..... G03G 15/553 399/33

FOREIGN PATENT DOCUMENTS

JP 2010-128474 A 6/2010
JP 5294815 B2 9/2013

* cited by examiner

*Primary Examiner* — Rodney Bonnette
(74) *Attorney, Agent, or Firm* — Fitzpatrick, Cella, Harper & Scinto

(57) ABSTRACT

An image forming apparatus includes a heating member which heats a recording material on which an unfixed toner image has been formed, a pressurizing member which forms a nip portion between the heating member and the pressurizing member and applies pressure to press the recording material against the heating member in the nip portion, and a controller which applies a voltage, which has a polarity opposite to the polarity of the surface potential of the charged pressurizing member and a predetermined voltage value with which electric discharge does not occur between a hole in a surface layer of the pressurizing member and the heating member, to the heating member to remove electricity from the surface layer of the pressurizing member when the recording material is not present in the nip portion.

18 Claims, 14 Drawing Sheets

| | IMAGE CONTAMINATION DUE TO LEAK | WAITING TIME (ELECTRICITY-REMOVING TIME) |
|---|---|---|
| CONSTANT AT 800 V | × | ◎ |
| CONSTANT AT 400 V | ◎ | × |
| EMBODIMENT (COMBINATION OF 400 V AND 600 V) | ◎ | ○ |

IMAGE FORMING APPARATUS HAVING HEATING UNIT HEATING RECORDING MATERIAL, PRESSURIZING UNIT FORMING A NIP BETWEEN ITSELF AND HEATING UNIT, AND CONTROL UNIT

BACKGROUND OF THE INVENTION

1. Field of the Invention

The present invention relates to an image forming apparatus including a fixing device that fixes a toner image onto a recording material.

2. Description of the Related Art

In the related art, an image forming apparatus, such as a copying machine or a printer employing an electrophotographic system, is provided with a fixing device employing a heat-fixing system as a unit that performs a fixing process on a recording material to which a toner image has been transferred. The fixing device includes a fixing film that rotates along an arc-like film guide, a heat source that is disposed at an inner side of the fixing film and that heats a recording material via the fixing film, and a pressure roller in which a heat-resistance elastic layer, such as a rubber material fixed to a mandrel, is coated with a resin tube.

In the fixing device, the film guide that supports the fixing film so as to be rotatable is impelled to the pressure roller by an elastic member, such as a coil spring, to press the fixing film against the pressure roller, and unfixed toner is fixed to a recording material on which the unfixed toner has been transferred by passing the recording material through a fixing nip portion formed by the pressurization to heat and pressurize the recording material.

In a dry environment in which humidity is low, when a recording material is passed to the fixing device, the surface layer of the pressure roller is gradually charged with a negative polarity by frictional charging between the transported recording material and the pressure roller and an electrostatic offset occurs in which negatively-charged toner on the recording material is attached to the fixing film. The electrostatic offset is prevented by applying a negative bias, which is higher than the negative voltage of the pressure roller, to the fixing film or replacing the rubber material of the pressure roller with a conductive material to lower the internal resistance of the pressure roller in order to suppress the electrostatic offset based on the negative charging of the pressure roller. However, with an increase in the a image forming speed, there is a problem in that the negative charging amount of the pressure roller increases due to an increase in a frictional charging amount and an increase in the applied negative bias.

Therefore, for example, Japanese Patent Laid-Open No. 2010-128474 discloses a configuration in which a high bias having the opposite-polarity of a fixing bias is applied in a period in which a recording material does not pass through the fixing nip portion. By applying the bias having the opposite-polarity in this way, an electric field is generated in the fixing nip portion to remove electricity of an insulating layer, which is the surface layer of the pressure roller, charged with the negative polarity in the period in which a recording material does not pass therethrough, whereby image failure, such as the electrostatic offset which occurs by charging the insulating layer, is prevented.

Here, when foreign substances such as a staple along with a recording material is transported to the fixing device, a hole may be formed in a film-like resin tube constituting the surface layer of the pressure roller in the fixing nip portion. When the hole has a small diameter, the hole does not affect the fixing operation and the fixing device can be continuously used. However, when a high bias having the opposite-polarity is applied to remove electricity from the surface layer of the pressure roller, even a hole having a small diameter may cause a problem with the application of the high bias. When a hole is formed in the insulating layer as the surface layer (resin tube) of the pressure roller, a conductive rubber material, which is grounded via the mandrel, is exposed from the hole. When a high bias having the opposite-polarity to the charging polarity of the pressure roller is applied to the fixing film to remove electricity, electric discharge occurs between the hole and the fixing film due to a potential difference between the grounded conductive rubber material of the pressure roller in the hole and the fixing film when the distance between the hole and the fixing film reaches a predetermined minute distance. In the place in which the electric discharge occurs, a coating layer, which is the surface layer of the fixing film, is damaged by the electric discharge and toner parting properties of the coating layer deteriorate. When the toner parting properties deteriorate, toner is attached to the surface of the fixing film and the attached toner is attached to a recording material, which is transported from the fixing nip portion, thereby causing image contamination.

SUMMARY OF THE INVENTION

The present invention provides an image forming apparatus that can prevent image failure due to damage of a heating member, such as a fixing film, in removing electricity from a surface layer of a pressurizing member of such as a pressure roller.

A representative configuration of the present invention is an image forming apparatus which forms an image on a recording material, comprising: a heating unit which heats the recording material to which a toner image has been transferred; a pressurizing unit which forms a nip portion between the heating unit and the pressurizing unit and presses the transported recording material against the heating unit in the nip portion; and a control unit which applies a voltage, with which electric discharge does not occur between the heating unit and the pressurizing unit, to at least one of the heating unit and the pressurizing unit even when a surface layer of the heating unit or the pressurizing unit is in a predetermined state.

In order to remove electricity of the pressurizing member in the invention, a voltage is applied with which electric discharge does not occur between the heating member to which a voltage supplied from the voltage application unit is applied and an abnormal place on the surface layer of the pressurizing member when a transported recording material is not present in the nip portion. Accordingly, it is possible to suppress electric discharge between the pressurizing member and the heating member, for example, even when a hole is formed in the insulating layer, which is the surface layer of the pressurizing member, and an underlying conductive rubber material is exposed.

Further features of the present invention will become apparent from the following description of exemplary embodiments with reference to the attached drawings.

DESCRIPTION OF THE EMBODIMENTS

Hereinafter, an image forming apparatus according to embodiments of the invention will be described with reference to the accompanying drawings. Numerical values or configurations described in the embodiments are merely mentioned for reference, and do not limit the invention.

First Embodiment

Schematic Configuration of Image Forming Apparatus

Figure 1:
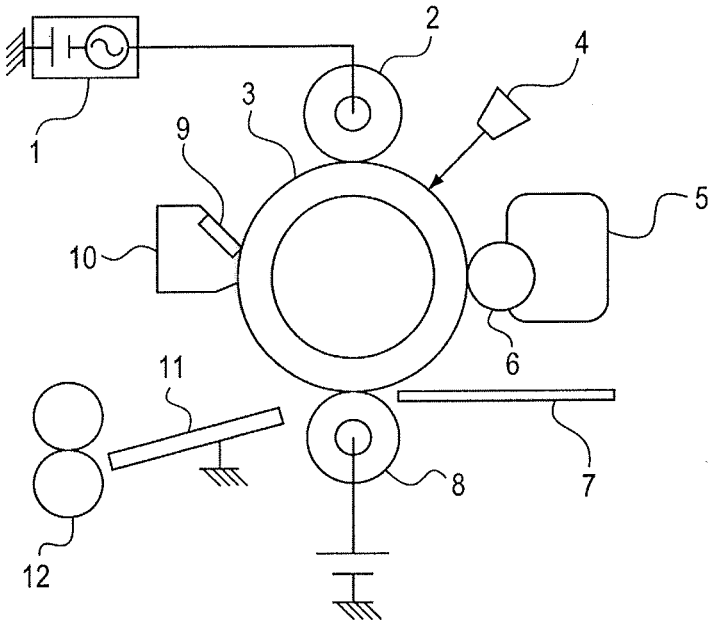
FIG. 1 is a diagram schematically illustrating a configuration of an image forming apparatus according to an embodiment of the invention.

FIG. 1 is a diagram schematically illustrating a configuration of an image forming apparatus.

As illustrated in the drawing, a photosensitive drum 3 (image bearing member) is charged to a predetermined potential with a charging roller 2 which is supplied with a voltage from a charging high-voltage power source 1. The photosensitive drum 3 is exposed with an exposure device 4 to lower the potential of the photosensitive drum 3 to a predetermined value. Toner in a developing container 5 is uniformly placed on a developing sleeve 6 and charged toner is attached to the photosensitive drum 3 using a difference between the potential of the photosensitive drum 3 of which the potential has been lowered and the potential applied to the developing sleeve 6, that is, using action of an electric field. A toner image formed on the photosensitive drum 3 is transferred to a recording material transported to a transfer area along a guide 7 by a transfer roller 8, and the recording material is transported along a guide 11, is subjected to a fixing operation by a fixing device 12, and is then discharged. Remaining toner attached to the photosensitive drum 3 and not transferred is scraped and recovered into a cleaner 10 by a cleaning blade 9.

(Configuration of Fixing Device)

Figure 2:
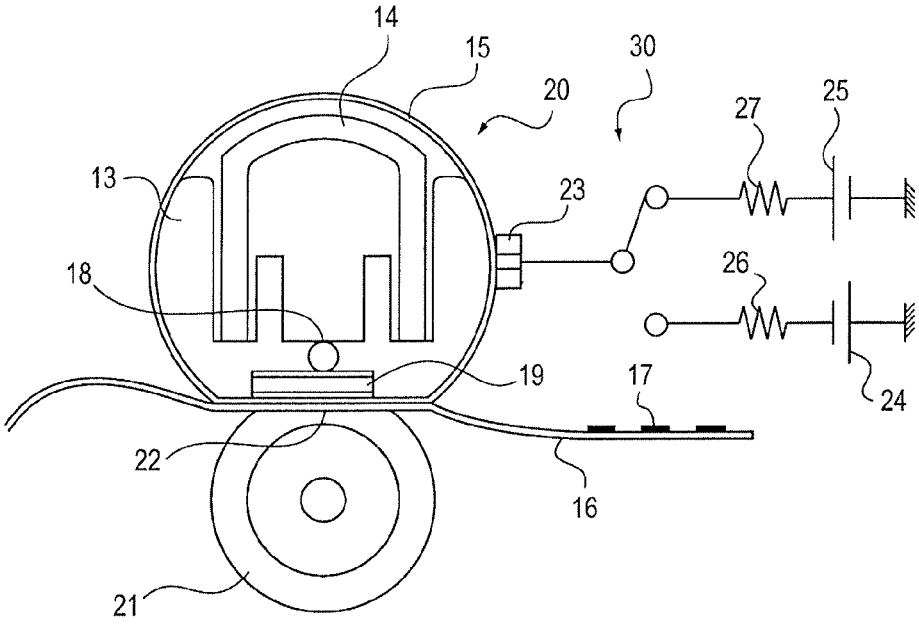
FIG. 2 is a cross-sectional view schematically illustrating a configuration of a fixing device of an image forming apparatus according to the embodiment of the invention.

FIG. 2 is a cross-sectional view schematically illustrating a configuration of the fixing device 12 of the image forming apparatus illustrated in FIG. 1.

The fixing device 12 includes a film unit 20 and a pressure roller 21 (pressurizing member). The film unit 20 includes a ceramic heater 19, a fixing film 15 (heating member) used to heat a recording material, a film guide 13, a T stay 14, and a thermistor 18 (temperature sensing element). The ceramic heater 19 includes a heat-emitting member in which a heat-emitting paste is printed on a ceramic substrate, and a glass coating layer used to protect the heat-emitting member and to secure insulation, and emits heat by supplying the heat-emitting member with a power-controlled AC current.

The fixing film 15 is formed of polyimide, has a cylindrical shape with a thickness of about 70 1.1 m, and efficiently transmits heat from the ceramic heater 19 to toner 17 on the recording material 16. The film guide 13 includes several ribs in the length direction thereof and thus assists circumferential movement of the fixing film 15, while suppressing resistance with respect to the fixing film 15. The T stay 14 is formed of a steel plate and uniformly applies a pressure. The thermistor 18 disposed in the back of the ceramic substrate senses a temperature and controls a heater driving unit (not illustrated) based on the sensing result so as to control power to the ceramic heater 19.

The pressure roller 21 has a roller shape and is rotatable about an axis. The pressure roller 21 is formed by coating a mandrel thereof with a conductive silicon rubber (elastic layer) with a volume resistivity of about $1\times10^5$ Ω·cm and coating the resultant with an insulating tube (surface layer) with a thickness of about 60 μm. By the film guide, which is impelled by an elastic member, such as a coil spring, toward the pressure roller 21, the ceramic heater 19 is pressed against the pressure roller 21 with a predetermined nip pressure with the fixing film 15 interposed therebetween to form a fixing nip portion 22 of 5 mm to 8 mm. The pressure roller 21 is rotationally driven by a motor, which is not illustrated in the drawing, which rotationally drives the fixing film 15, and transports the recording material 16 introduced into the fixing nip portion 22 in a state in which the recording material is in close contact with the fixing film 15. By transporting the recording material 16 to the fixing nip portion 22 in this way, the unfixed toner 17 transferred onto the recording material 16 is fixed with the heat of the ceramic heater 19 and the pressure of the fixing nip portion 22. Here, when foreign substances such as staples are transported into the fixing device along with the recording material, a hole may be formed in the film-like resin tube constituting the surface layer of the pressure roller in the fixing nip portion. The state in which a hole is formed is a predetermined state of the surface layer in the invention.

A negative (the same polarity as the toner, second polarity) bias of a high-voltage power source 24 disposed in the apparatus body is input to a switch 30 via a protective resistor 26. A positive bias (the opposite-polarity of the toner, first polarity) of a high-voltage power source 25 disposed in the apparatus body is input to the switch 30 via a protective resistor 27.

When performing a fixing operation on the recording material, a negative bias, which is the same polarity as toner, is applied to the fixing film 15 via the protective resistor 26 and a brush 23, which is in contact with the fixing film 15 by the switch 30. By applying a negative film bias when performing a fixing operation, an electric field, which acts on the toner in a direction from the fixing film 15 to the pressure roller 21, is generated in the fixing nip portion 22. Accordingly, a force in a direction in which an image of the unfixed toner 17 is pressed against the recording material 16 is generated, thereby preventing an electrostatic offset.

On the other hand, in a period in which a recording material does not pass through the fixing nip portion, a positive bias, which is the opposite-polarity of the toner 17, is applied to the fixing film 15 via the protective resistor 27 and the brush 23 by the switch 30. The charge on the surface layer of the pressure roller 21, which has been negatively charged, is removed. A film bias, which has the opposite-polarity of the toner 17, is applied in a non-passing period in which a recording material does not pass through the fixing nip portion 22 (at least when a toner image of a recording material is not present). Accordingly, the change in polarity of the bias applied to remove charge on the surface of the pressure roller 21 does not directly affect the unfixed toner 17 on the recording material 16.

In this embodiment, the polarity of the voltage applied to the fixing film 15 is changed by switching the power source between the high-voltage power source 24 and the high-voltage power source 25 using the switch 30, but another method may be used as long as the biases of two polarities can be applied.

The high-voltage power sources 24 and 25, the brush 23, and the switch 30 constitute a voltage application unit that is voltage application means.

Figure 3:
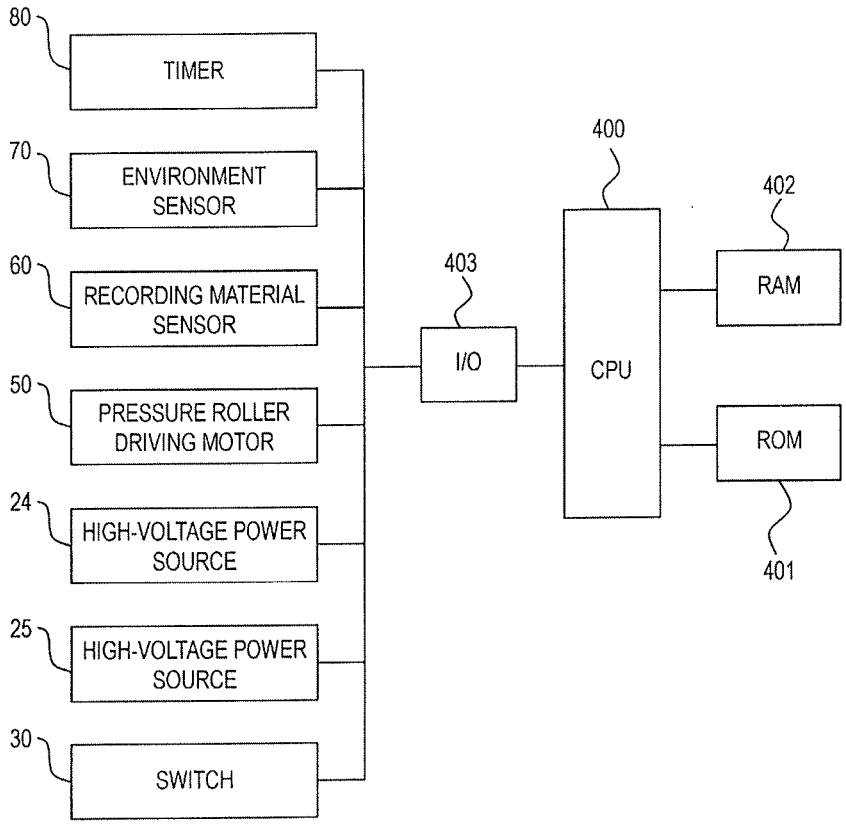
FIG. 3 is a diagram illustrating a configuration of a controller of the image forming apparatus according to the embodiment of the invention.

(Configuration of Controller) FIG. 3 is a diagram illustrating a configuration of a controller that performs an operation of switching the switch 30 or the like. As illustrated in the drawing, the controller includes a CPU 400 that performs processes according to programs, a ROM 401 that stores the programs performed by the CPU 400 or data, and a RAM 402, which is a memory area used as a work area or the like. The CPU 400 is connected to the constituent units of the image forming apparatus such as the switch 30, the high-voltage power sources 24 and 25, a pressure roller driving motor 50, a recording material sensor 60, an environment sensor 70, and a timer 80 which measures time via an I/O interface 403.

(Number of Sheets Passed and Surface Potential of Pressure Roller)

Figure 4:
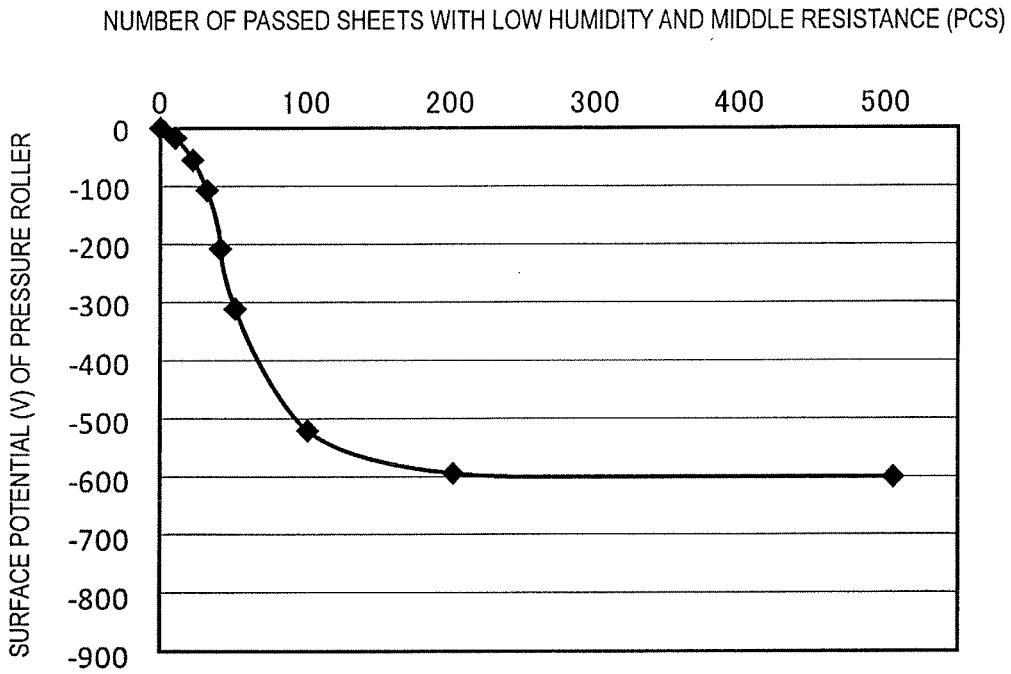
FIG. 4 is a graph illustrating the number of sheets passed and a change of a surface potential of a pressure roller in the image forming apparatus according to the embodiment of the invention.

FIG. 4 is a graph illustrating the number of sheets passed with a middle resistance value and a change of the surface potential of the pressure roller 21 under an environment with low humidity.

As illustrated in the drawing, as the number of sheets the recording material 16 passes through the fixing nip portion 22 increases, the surface of the pressure roller 21 is gradually charged to a negative polarity (charging polarity) by the friction between the recording material 16 and the pressure roller 21 or the influence of the film bias for preventing an electrostatic offset.

When the number of recording materials 16 passed is over about 200, it can be seen that the surface potential of the pressure roller 21 is stabilized at about −600 V. When the surface potential of the pressure roller 21 further increases to the negative polarity, negatively-charged unfixed toner is easily electrically attached to the fixing film 15 from the recording material 16 and an offset is easily caused.

(Electricity-Removing Voltage of Surface of Pressure Roller 21)

Figure 5:
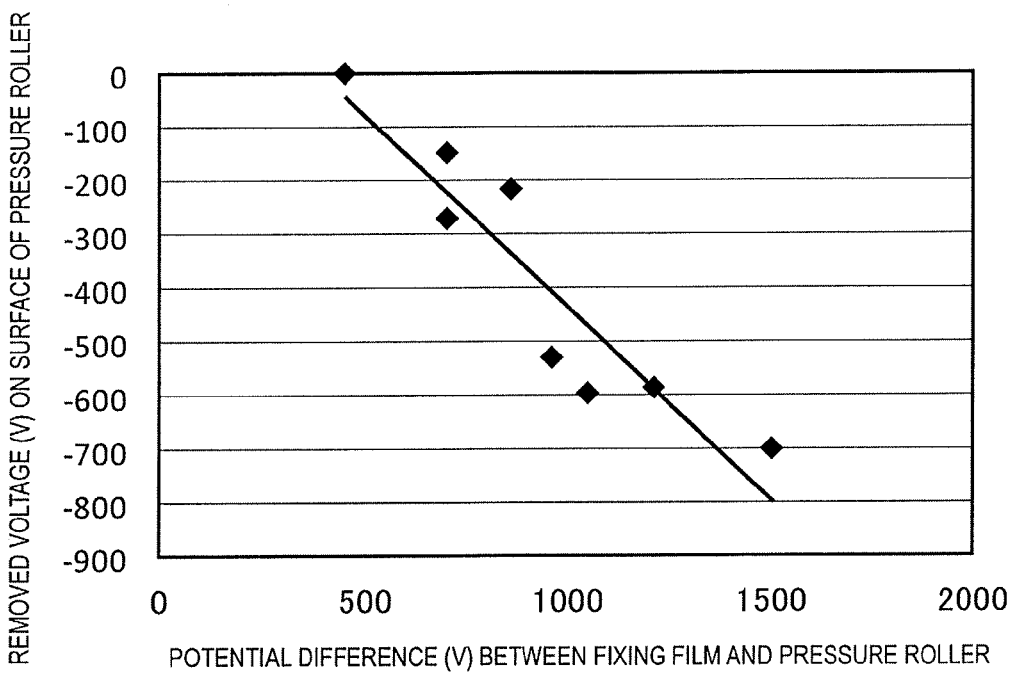
FIG. 5 is a graph illustrating a relationship between a potential difference between a fixing film and the surface of the pressure roller and an electricity-removing voltage on the surface of the pressure roller when a positive bias is applied to a fixing film in the image forming apparatus according to the embodiment of the invention.

FIG. 5 is a graph illustrating a relationship between the potential difference between the fixing film 15 and the surface of the pressure roller 21 and an electricity-removing voltage on the surface of the pressure roller 21 when a positive bias is applied to the fixing film 15.

As illustrated in the drawing, when the potential difference between the fixing film 15 and the surface of the pressure roller 21 is about 450 V, the potential of the surface of the pressure roller 21 cannot be removed (neutralized). However, for example, when the positive value of the film bias is increased and the potential difference from the surface of the pressure roller 21 is increased to about 1500 V, it can be seen that the potential of the surface of the pressure roller 21 can be removed by about 790 V. As a result, it can be seen that the effect of removing charge on the surface of the pressure roller 21 is improved by increasing the positive value of the film bias.

(Amount of Current Between Fixing Film and Pressure Roller)

Figure 6:
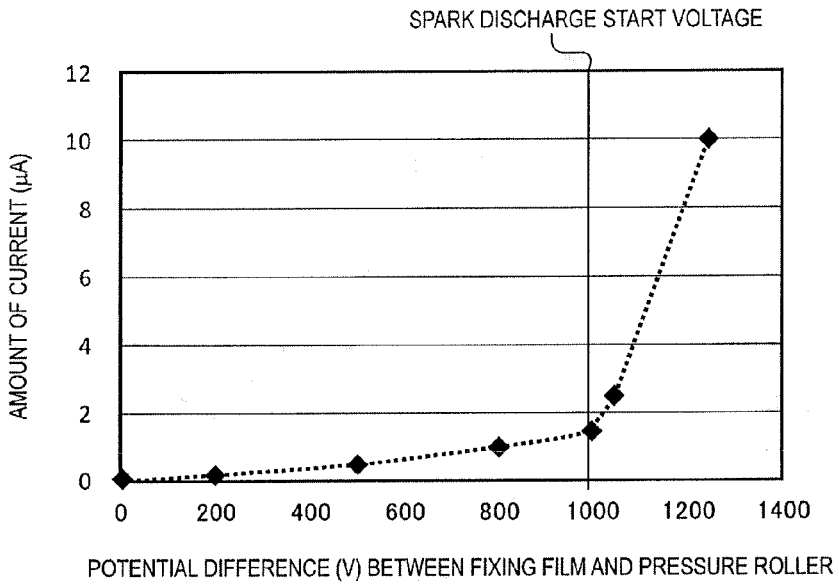
FIG. 6 is a graph illustrating a relationship between a potential difference between a film bias and the surface of the pressure roller and an amount of current between the fixing film and the pressure roller when a hole is formed in an insulating layer as a surface layer of the pressure roller and a positive bias is applied to the fixing film in the image forming apparatus according to the embodiment of the invention.

FIG. 6 is a graph illustrating a relationship between the potential difference between the fixing film 15 and the surface of the pressure roller 21 and an amount of current between the fixing film 15 and the pressure roller 21 when a hole is formed in the insulating layer as the surface layer of the pressure roller 21 and a positive bias is applied to the fixing film 15.

As illustrated in the drawing, when the potential difference between the fixing film 15 and the surface of the pressure roller 21 is about 500 V, the amount of current flowing between the fixing film 15 and the pressure roller 21 is about 1 μA. When the potential difference between the fixing film 15 and the surface of the pressure roller 21 is about 1000 V, the amount of current is about 2 μA. When the potential difference between the fixing film 15 and the surface of the pressure roller 21 is about 1050 V, the amount of current is about 3 μA. When the potential difference between the fixing film 15 and the surface of the pressure roller 21 is about 1200 V, the amount of current is about 10 μA. As a result, it can be seen that electric discharge occurs between the fixing film 15 and the surface of the pressure roller 21 when the potential difference between the fixing film 15 and the surface of the pressure roller 21 is greater than about 1000 V. Accordingly, in order to prevent electric discharge from occurring between the fixing film 15 and the surface of the pressure roller 21, it is necessary to set the potential difference between the fixing film 15 and the surface of the pressure roller 21 to be equal to or less than about 1000 V.

(Electricity Removal Effect when Film Bias is Applied)

Figure 7:
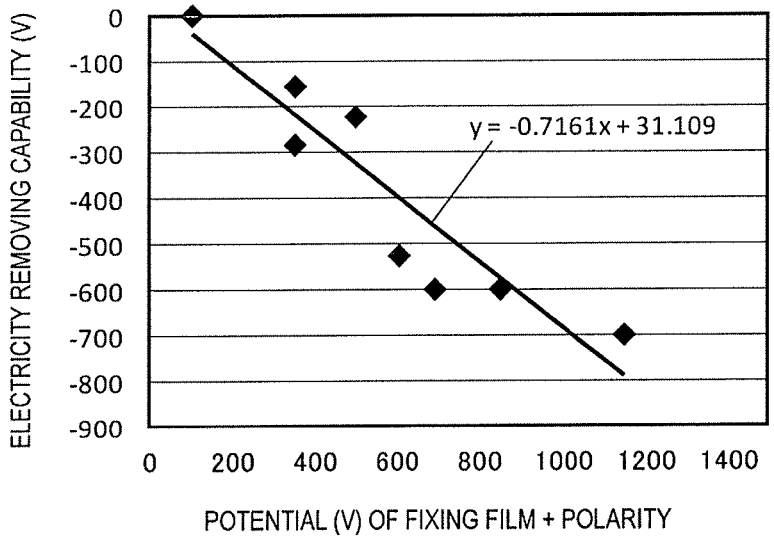
FIG. 7 is a graph illustrating a relationship of an electricity removal effect of the surface layer of the pressure roller when the surface of the pressure roller is charged to −600 V and a positive voltage is applied as the film bias in the image forming apparatus according to the embodiment of the invention.

FIG. 7 is a graph illustrating a relationship of an electricity removal effect of the surface layer of the pressure roller when the surface of the pressure roller 21 is charged to −600 V and a positive voltage is applied as the film bias.

As illustrated in the drawing, in order to remove electricity of the surface layer of the pressure roller 21 to about −600 V, it is necessary to apply a voltage of about +800 V as the film bias. However, when a bias of about +800 V is applied as the film bias, the potential difference between the fixing film 15 and the surface of the pressure roller 21 is about 1400 V. In this case, as illustrated in FIG. 6, the potential difference between the fixing film 15 and the surface of the pressure roller 21 is greater than about 1000 V and electric discharge occurs between the fixing film 15 and the hole in the surface layer of the pressure roller 21, thereby damaging the film surface.

When a potential difference with which electric discharge does not occur between the fixing film 15 and the hole in the surface layer of the pressure roller 21, for example, a bias of about +400 V, is applied as the film bias, the potential difference between the fixing film 15 and the surface of the pressure roller 21 is about 1000 V and electric discharge does not occur between the fixing film 15 and the hole in the surface layer of the pressure roller 21. However, when the film bias is about +400 V, the charge on the surface layer of the pressure roller 21 can be removed by only about −200 V and prevention of an offset cannot be achieved.

Figures 8A, 8B:
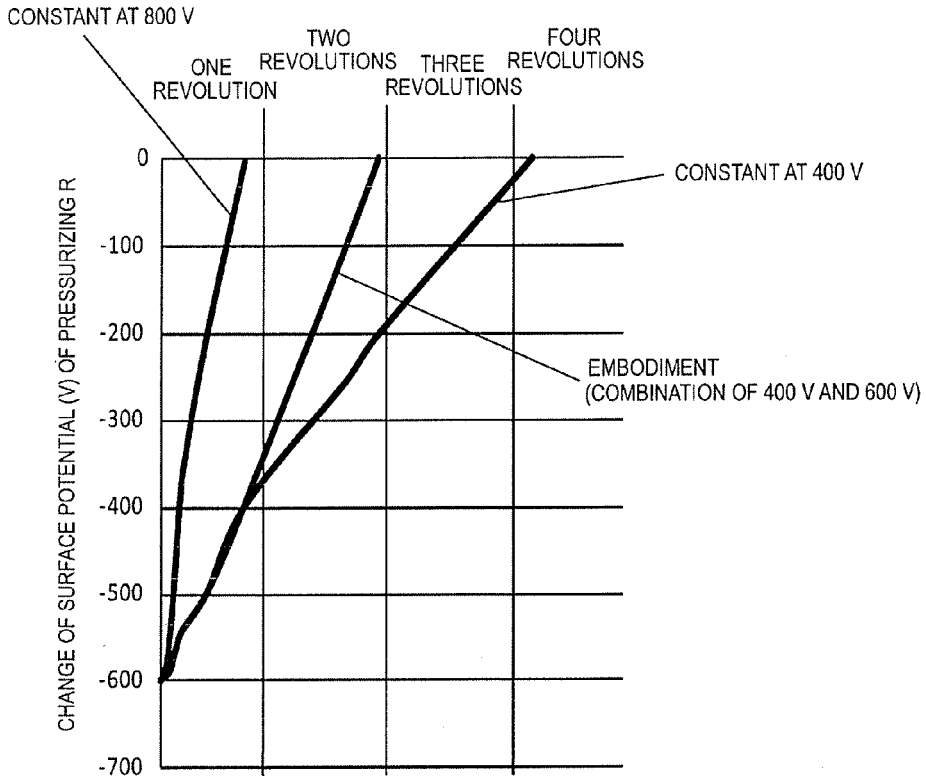
FIG. 8A is a graph illustrating the number of revolutions of the pressure roller until the potential −600 V of the surface layer of the pressure roller is removed when different voltages are applied as the film bias in the image forming apparatus according to the embodiment of the invention.
FIG. 8B is a table illustrating image quality and waiting time when different voltages are applied as the film bias in the image forming apparatus according to the embodiment of the invention.

(Surface Potential of Pressure roller when Different Voltage Values are applied as Film Bias) FIG. 8A is a graph illustrating the number of revolutions of the pressure roller 21 until the charge of −600 V of the surface layer of the pressure roller 21 is removed when different voltages are applied as the film bias. FIG. 8B is a table illustrating image quality and the waiting time when different voltages are applied as the film bias.

As illustrated in the drawings, when the film bias is constant at +800 V, the charge of −600 V on the surface layer of the pressure roller 21 can be removed in one revolution, but electric discharge occurs between the fixing film 15, to which the film bias has been applied, and the hole in the surface layer of the pressure roller 21. The surface layer of the fixing film is damaged by this electric discharge, thereby causing image contamination.

When the film bias is constant at +400 V, electric discharge does not occur between the fixing film 15, to which the film bias has been applied, and the hole in the surface layer of the pressure roller 21, but the electricity removal effect of the surface layer of the pressure roller 21 is low during the time corresponding to one revolution of the pressure roller 21 and thus an electrostatic offset occurs. In order to remove a charge of −600 V on the surface layer of the pressure roller 21 to prevent the electrostatic offset, the time corresponding to four revolutions of the pressure roller 21 is required and it is thus necessary to provide a lot of waiting time until a next print job.

Accordingly, in order to remove electricity from the surface of the pressure roller 21 without causing electric discharge between the fixing film 15, to which the film bias has been applied, and the hole in the surface layer of the pressure roller 21, it can be seen that weak electricity removal of applying a low film bias first only has to be performed to lower the potential of the pressure roller 21 and then main electricity removal of applying a high film bias only has to be performed.

Here, when a print job is started, the fixing film 15 and the pressure roller 21 are rotationally driven (pre-rotated) as preparation before a print job. By the frictional charging between the fixing film 15, which rotates as a follower and the pressure roller 21, which is rotationally driven, the surface layer of the pressure roller 21 from which electricity has been removed to 0 V before a print job is charged to about −300 V before the recording material 16 passes through the fixing nip portion 22 and is returned to the negatively-charged state. Accordingly, the effect of electricity removal to 0 V cannot be efficiently used. By allowing the recording material 16 to pass through the fixing nip portion 22, the frictional charging is further enhanced and when it is assumed that the number of recording materials 16 subjected to a fixing process is about 30 sheets, the surface layer is charged to about −430 V (see the relationship between the number of sheets passed and the surface potential of the pressure roller which is illustrated in FIG. 4). Accordingly, the electrostatic offset is enhanced. As a result, it is necessary to remove electricity of the pressure roller 21 at the time of the pre-rotation during a print preparation operation before performing the print job.

By performing two types of electricity removal of peak electricity removal and main electricity removal in a period of time corresponding to one revolution of the pressure roller 21, electricity can be removed from the surface of the pressure roller without causing electric discharge even when a hole is formed in the surface layer of the pressure roller 21, but the start time of the print job is delayed when two types of electricity removal is performed before the print job. On the contrary, when two types of electricity removal are performed after the print job, the pressure roller from which electricity has been removed before the pressure roller rotates at the time of start of the print job is frictionally charged by the pre-rotation before the print job, as described above, and thus the two types of electricity removal which have been performed after the print job are useless when removal of the frictional charge is intended, thereby shortening the lifetime of components such as the pressure roller, which are driven for the electricity removal.

Accordingly, in this embodiment, an electricity removing operation is performed during a print preparation operation before a print job and during a print ending operation after a print job. In this embodiment, electricity is not completely removed from the surface layer of the pressure roller 21 after a print job ends and weak electricity removal of partially lowering the potential of the surface layer of the pressure roller 21 is performed. Accordingly, the charging amount of the pressure roller 21 before a next print job is about −100 V.

When a print job is started, the fixing film 15 and the pressure roller 21 are rotated (pre-rotated) as preparation. At this time, in order to remove charge remaining on the surface layer of the pressure roller 21, a film bias of about +600 V is applied to the fixing film 15. At this time, even when the charging due to the pre-rotation is applied to +600 V of the film bias and the charging amount −100 V of the surface layer of the pressure roller 21, the difference therebetween can be less than 1000 V. Accordingly, even when a hole is formed in the surface layer of the pressure roller 21, electric discharge does not occur between the fixing film 15 and the pressure roller 21. Accordingly, electric charge remaining on the surface layer of the pressure roller 21 can be removed before starting a fixing operation, electric charge due to the frictional charging based on the pre-rotations of the fixing film 15 and the pressure roller 21 can also be removed, and the potential of the surface layer of the pressure roller 21 before a recording material 16 passes through the fixing nip portion 22 can be maintained at about 0 V.

Even when the surface layer of the pressure roller 21 is frictionally charged by passing a recording material 16 through the fixing nip portion 22 in this state and it is assumed, for example, that the number of recording materials 16 to be subjected to a fixing operation is about 30, the charging amount can be suppressed to about −150 V and it is thus possible to prevent an electrostatic offset from occurring.

As described above, in the first embodiment, when electric charge of the surface layer of the pressure roller 21 is removed, applying once a film bias with a voltage value with which electric discharge occurs between the fixing film 15 and the hole in the surface layer of the pressure roller 21 is avoided and the film bias is divisionally applied multiple times with a voltage with which electric discharge does not occur.

Therefore, in this embodiment, after a print job ends, a film bias of +400 V is applied and electricity removal of −200 V is performed on the surface layer of the pressure roller 21 to lower the potential of the surface layer of the pressure roller 21 to −400 V. When starting a next print job, for example, at the time of pre-rotation for preparation for printing, a film bias of +600 V is applied to remove the potential of the surface layer of the pressure roller 21 by −400 V as illustrated in FIG. 7. As a result, since electricity can be removed from the surface layer of the pressure roller 21 without causing electric discharge to occur between the fixing film 15, to which the film bias has been applied, and the hole in the surface layer of the pressure roller 21, it is also possible to reduce unnecessary waiting time of a user.

(Operation of Controlling Film Bias)

Figure 9:
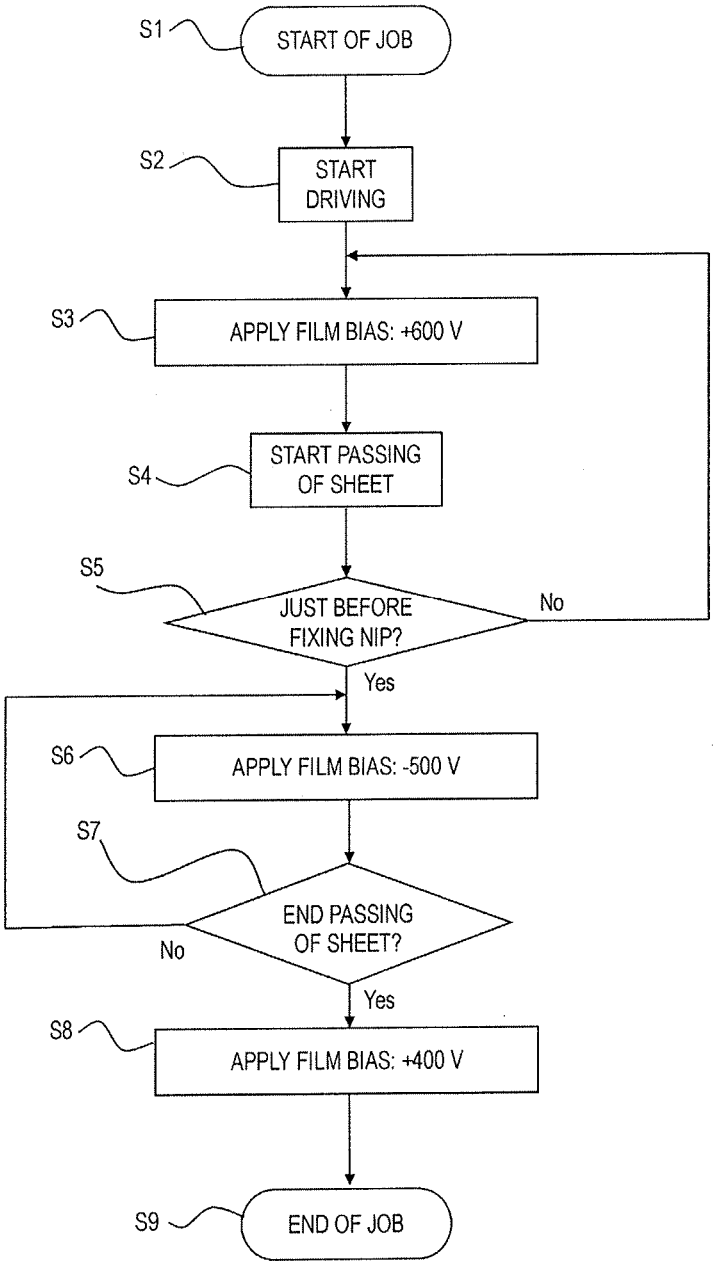
FIG. 9 is a flowchart illustrating an operation of applying the film bias in the image forming apparatus according to the embodiment of the invention.

FIG. 9 is a flowchart illustrating an operation of applying a film bias when a print job is performed in this embodiment. The operations of the flowchart are performed by the CPU 400 of the controller.

In this embodiment, there is provided an electricity removal mode in which electricity removal is divisionally performed by first application (weak electricity removal) of applying a film bias when formation of an image ends after a print job and second application (main electricity removal) of applying a film bias when formation of a next image is started. An operation of removing electricity from the pressure roller 21 in this electricity removal mode will be described below with reference to FIG. 9.

When a print job is instructed (S1), first, a print preparation operation is started and the pressure roller 21 are rotationally driven as preparation for a fixing process (S2). Then, in order to remove remaining charge on the surface layer of the pressure roller 21, +600 V is applied as a film bias to the fixing film 15 (S3). This electricity removing operation is carried out (NO in S5) until a recording material 16 arrives at the fixing nip portion 22 after transport of the recording material 16 is started (S4). That is, a bias for removing electricity from the pressure roller 21 is performed until the fixing operation is started after an image forming operation is started.

When it is sensed that the recording material 16 arrives as the fixing nip portion 22 (YES in S5), the fixing operation is started and −500V is applied as a film bias to the fixing film 15 so as not to electrically attach toner having a negative polarity to the fixing film 15 (S6).

When it is sensed that a recording material 16 passes through the fixing nip portion 22 (end of sheet passing), the application of the film bias of −500 V is stopped (S7) and the fixing operation ends.

Then, in order to remove a part of electric charge remaining on the surface layer of the pressure roller 21, a voltage having a polarity opposite to the charged polarity of the surface of the pressure roller 21 is applied to the fixing film 15. At this time, a voltage having a value smaller than the absolute value of the voltage applied for electricity removal at the time of start of the image formation, that is, +400 V in this embodiment, is applied (weak electricity removal is performed) (S8) and a series of fixing processes ends (S9). Even if the pressure roller 21 is charged to −600 V (see FIG. 4) which is a maximum value to which the pressure roller can be charged by sheet passing when performing electricity removal at the time of end of the image formation, +400 V is applied so as not to cause electric discharge to occur between the fixing film 15 and the hole in the surface layer of the pressure roller 21.

In this way, since removal of electric charge on the surface layer of the pressure roller 21, which is performed until a next print job after the end of the fixing operation, is not performed up to 0 V, the time required for only the electricity removal is shortened. The electric charge remaining on the surface layer of the pressure roller 21 is removed by the frictional charging between the fixing film 15 and the pressure roller 21 during the rotational driving before a recording material 16 passes through the fixing nip portion 22 before starting the fixing operation in a next print job (main electricity removal). Accordingly, It is possible to shorten the waiting time before starting a print job and to remove the electric charge on the surface layer of the pressure roller 21 up to 0 V at the time of start of the fixing operation.

As described above, the application of a bias for removing electric charge of the pressure roller 21 is divisionally performed after the fixing operation ends and before the fixing operation at the time of formation of a next image starts, a first applied bias value for electricity removal, which is applied after the fixing operation ends, is set to be smaller than a second applied bias value for electricity removal, which is applied before the fixing operation at the time of formation of a next image starts. Accordingly, even when the charging amount of the pressure roller 21 is great just after an image is formed, it is possible to satisfactorily prevent electric discharge between the fixing film 15 and the pressure roller 21 by setting the bias value for electricity removal to be small. By setting the applied bias value for electricity removal to be greater than that in the first application at the time of start of formation of a next image, it is possible to satisfactorily remove electric charge on the pressure roller 21 and to suppress charging while a recording material is transported to the fixing nip.

Second Embodiment

An image forming apparatus according to another embodiment of the invention will be described below. In the first embodiment, the control of removing electricity from the surface layer of the pressure roller at the time of end of a print job and at the time of start of a print job has been described, but electricity removal control of changing a film bias at a sheet interval in an image formation print job, such that the voltage gradually increases within a range in which electric discharge does not occur when a hole is formed in the surface layer of the pressure roller 21 and applying the changed film bias, will be described in this embodiment. The basic configuration of this embodiment is similar to that of the first embodiment, and therefore, a description thereof will not be repeated, and only differences from the first embodiment will be described below.

Figure 10:
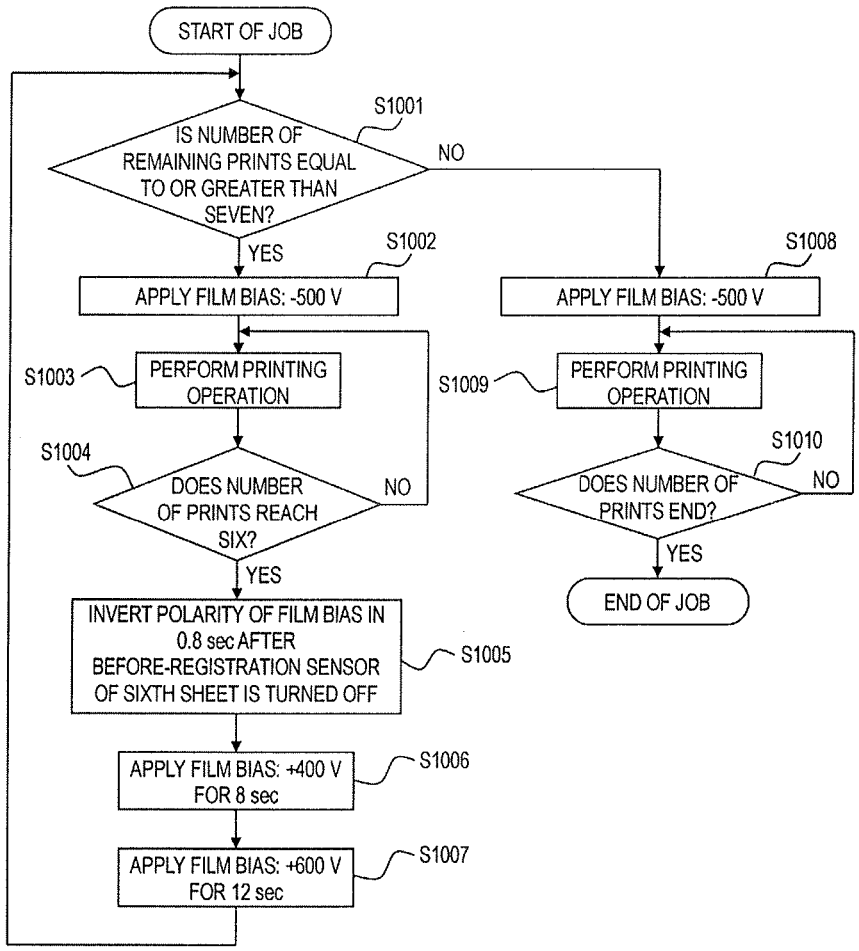
FIG. 10 is a flowchart illustrating an operation of applying a film bias in an image forming apparatus according to another embodiment of the invention.

FIG. 10 is a flowchart illustrating an operation of applying a film bias when a print job is performed in this embodiment. The operations of the flowchart are performed by the CPU 400 of the controller.

As illustrated in the drawing, when the number of prints remaining is equal to or greater than 7 after a print job is started (step S1001), a film bias of −500 V is applied (step S1002). Then, a printing operation is continuously performed (step S1004) until the number of prints is 6 (step S1003). In this embodiment, the timing at which a recording material passes through the fixing device is measured by a pre-registration sensor which is the recording material sensor 60. When 0.8 seconds passes after the sixth recording material passes through the pre-registration sensor and an off state is started, the polarity of the film bias is inverted (step S1005). Then, +400 V is applied as a film bias for 8 seconds (step S1006) and then +600 V is applied for 12 seconds (step S1007).

On the other hand, when the number of prints remaining is less than 7 in step S1001, −500 V is applied as a film bias (step S1008), a printing operation is performed (steps S1009 and S1010), and then the print job ends.

In this way, the electricity removal control of changing a film bias at a sheet interval in an image formation print job such that the voltage gradually increases within a range in which electric discharge does not occur when a hole is formed in the surface layer of the pressure roller 21 and applying the changed film bias is performed.

That is, in the flowchart illustrated in FIG. 10, the sheet interval increases every 6 sheets and the following operations 1) to 4) are performed.

1) The − component of a film bias is deactivated (step S1005).

The − component of the film bias is turned off after six recording materials have passed through the fixing device.

2) The + component of the film bias is activated in an interval of recording materials (steps S1006 and S1007).

The + component of the film bias is activated after the − component of the film bias is deactivated.

The + component (+400 V) of a film bias is applied for 8 seconds and then the + component (+600 V) of a film bias is applied for 12 seconds.

3) The + component of a film bias is deactivated.

A sheet supply is permitted when the + component of a film bias is deactivated.

4) The − component of a film bias is activated (step S1002).

According to this embodiment, it is possible to remove electricity without discharging the surface layer of the pressure roller using a sheet interval even when the surface layer of the pressure roller is gradually charged to the negative polarity at the time of continuously forming images. In this embodiment, the removal of electricity from the surface layer of the pressure roller is performed at a sheet interval after the sixth sheet is printed, but since the frictional charging amount of the surface layer of the pressure roller is affected by the type of a recording material to be transported, the timing at which the electricity removal is performed at a sheet interval at the time of forming images may be changed depending on the type of the recording material.

The first embodiment may be carried out before and after a print job and the second embodiment may be performed at a sheet interval in the print job.

Third Embodiment

An image forming apparatus according to another embodiment of the invention will be described below. This embodiment relates to electricity removal control when absolute humidity differs. The basic configuration of this embodiment is similar to that of the first embodiment, description thereof will not be repeated, and only differences from the first embodiment will be described below.

Figure 11:
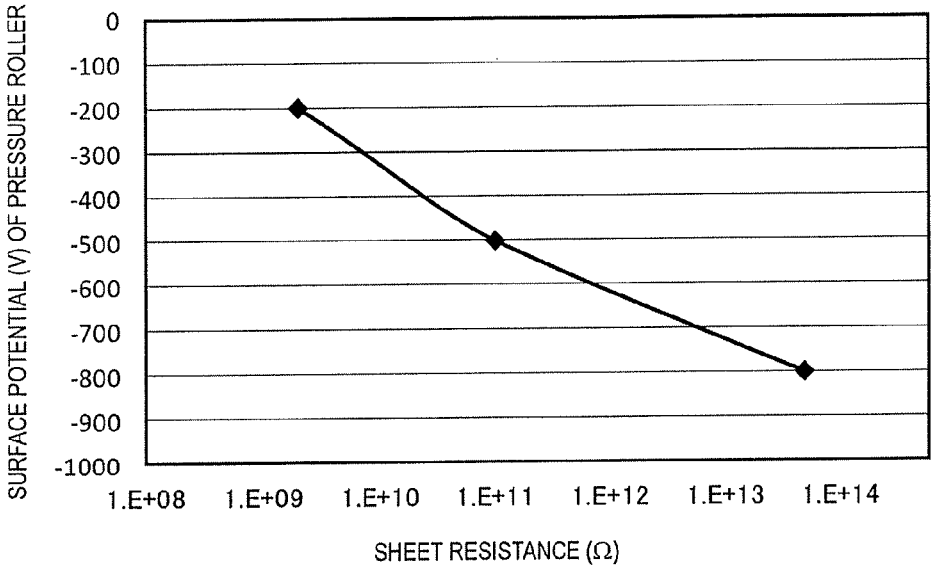
FIG. 11 is a graph illustrating a relationship of a saturated potential of the surface of a pressure roller when sheets having different resistance values are continuously passed in an image forming apparatus according to another embodiment of the invention.

FIG. 11 is a graph illustrating a relationship of a saturated potential of the surface of the pressure roller when sheets having different resistance values are continuously passed.

For example, when sheet resistance is about $1\times10^{11}\Omega$, the surface potential of the pressure roller is saturated at about −500 V. When the sheet resistance is about $1\times10^{13}\Omega$, the surface potential of the pressure roller is charged to about −800 V. Accordingly, it can be seen that as the sheet resistance becomes greater, the saturated potential of the surface of the pressure roller is further charged to the negative polarity.

Figure 12:
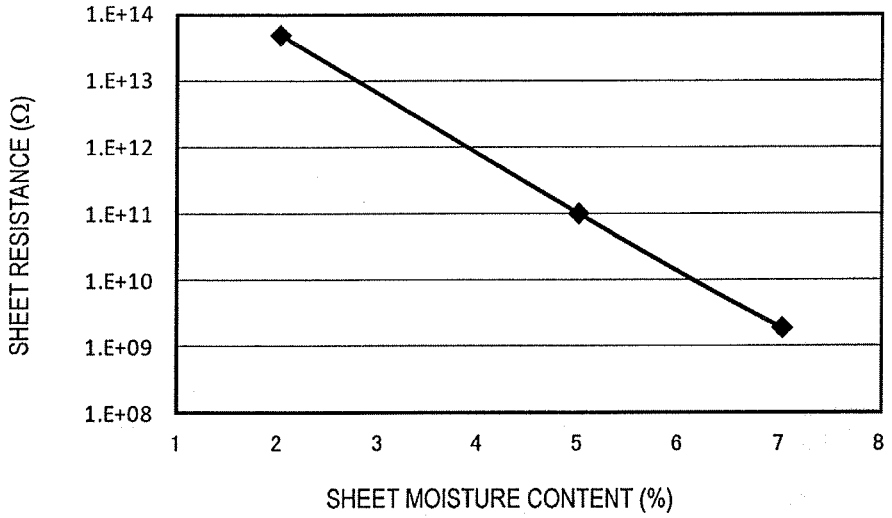
FIG. 12 is a graph illustrating a relationship between sheet resistance and a sheet moisture content in an image forming apparatus according to another embodiment of the invention.

FIG. 12 is a graph illustrating a relationship between sheet resistance and sheet moisture content.

When the sheet moisture content is about 7%, the sheet resistance is about $1\times10^{9}\Omega$. When the sheet moisture content is about 2%, the sheet resistance is about $1\times10^{13}\Omega$. Accordingly, it can be seen that as the sheet moisture content becomes lower, the sheet resistance becomes higher.

Figure 13:
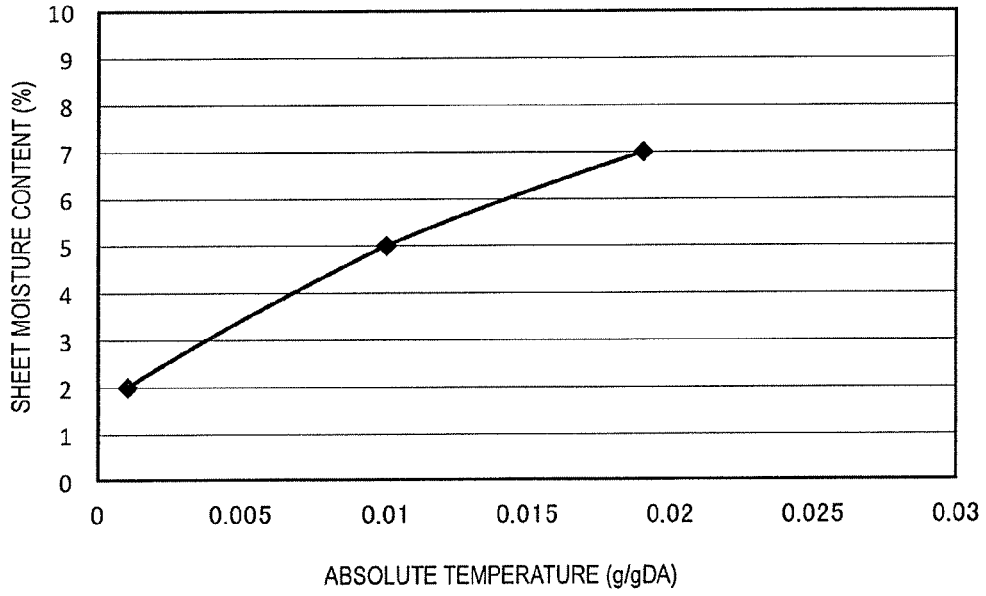
FIG. 13 is a graph illustrating a relationship of sheet moisture content when a sheet is placed under an environment of absolute humidity for one day in an image forming apparatus according to another embodiment of the invention.

FIG. 13 is a graph illustrating a relationship of a sheet moisture content when a sheet is placed in an environment of absolute humidity for one day.

For example, the sheet moisture content is about 2% in an environment in which the absolute humidity is 0.001 (g/gDA), and the sheet moisture content is about 7% in an environment in which the absolute humidity is 0.019 (g/gDA). Accordingly, it can be seen that as the absolute humidity becomes lower, the sheet moisture content becomes lower.

For the above-mentioned reasons, the surface potential of the pressure roller differs depending on the environment (absolute humidity). That is, as the absolute humidity becomes lower, the surface potential of the pressure roller 21 becomes lower. Accordingly, in this embodiment, electric discharge between the fixing film and a hole in the surface layer of the pressure roller is prevented by changing the voltage value of the bias applied to the fixing film at the time of removal of electricity from the pressure roller 21 to correspond to the surface potential of the pressure roller 21, which varies depending on the environment. A sensor (environment sensor) that can sense the temperature and the relative humidity is installed in a place that is not affected by an internal temperature rise of the device body so as to know the environmental conditions of the environment in which the body is installed, and the absolute temperature is calculated from the temperature and the relative humidity. The sensor and the calculation unit that calculates the absolute humidity constitute an absolute humidity detector.

There is a possibility that the surface potential of the pressure roller will be charged to −500 V when the calculated absolute humidity is, for example, 0.019 (g/gDA) and the surface potential of the pressure roller will be charged to −800 V when the calculated absolute humidity is, for example, 0.001 (g/gDA). As illustrated in FIG. 6, when the potential difference between the fixing film 15 and the surface of the pressure roller 21 is greater than about 1000 V, electric discharge occurs between the fixing film 15 and the surface of the pressure roller 21, thereby damaging the film surface layer. Accordingly, the initial value of the voltage at the time of changing the minus polarity in the sheet passing to the plus polarity in the end of the sheet passing is +200 V when the calculated absolute humidity is, for example, 0.001 (g/gDA) and is +500 V when the calculated absolute humidity is, for example, 0.019 (g/gDA). In this way, by decreasing the plus initial value and gradually increasing the output power as the calculated absolute humidity becomes lower, it is possible to suppress damage of the film surface layer.

Figure 14:
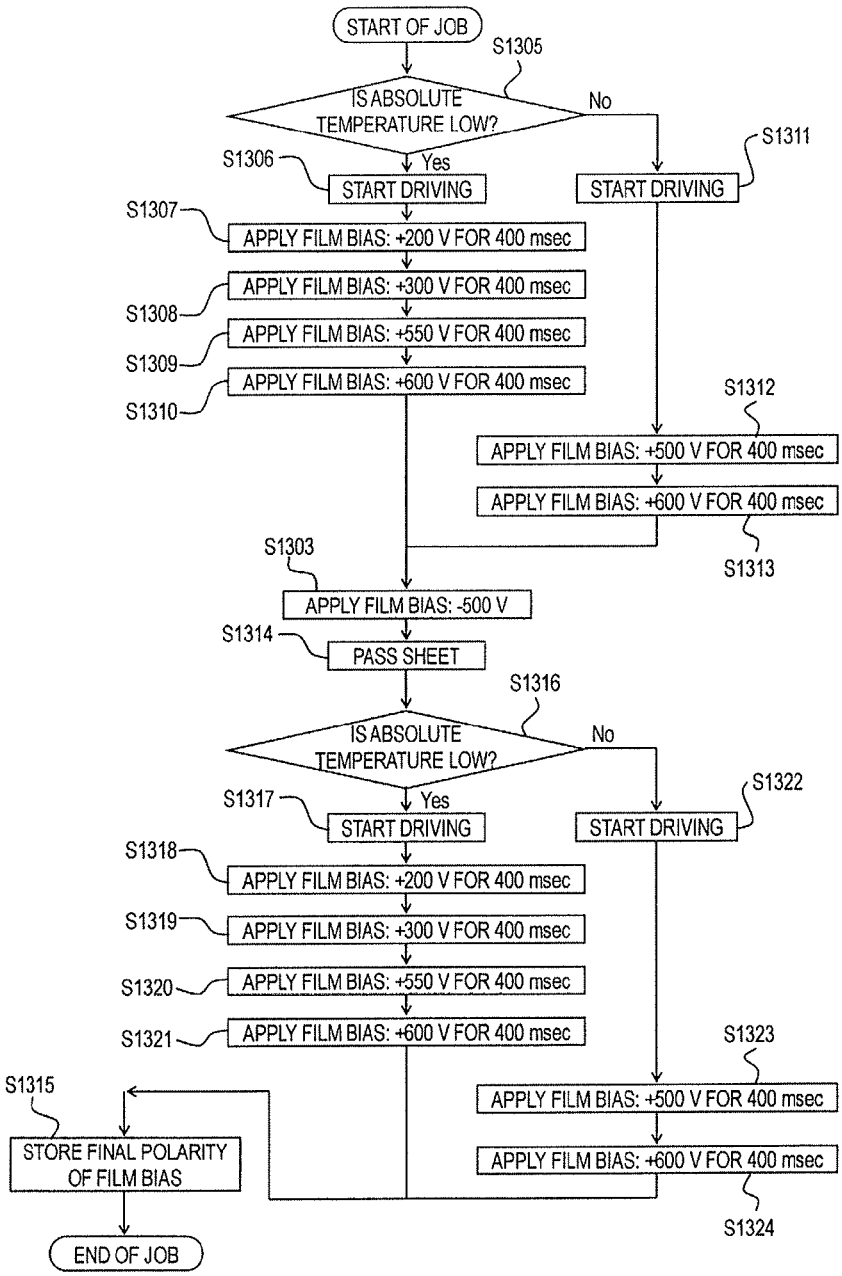
FIG. 14 is a flowchart illustrating an operation of applying a film bias in an image forming apparatus according to another embodiment of the invention.

FIG. 14 is a flowchart illustrating an operation of applying a film bias in this embodiment. The operations of the flowchart are performed by the CPU 400 of the controller.

The absolute humidity is checked and the device body is driven for removal of electricity from the surface layer of the pressure roller (step S1306) when the absolute humidity is lower than a predetermined value (for example, 0.001 (g/gDA)) (step S1305). Thereafter, +200 V is applied as a film bias for about 400 msec which corresponds to one revolution of the pressure roller (step S1307). Then, +300 V is applied as a film bias for about 400 msec which corresponds to one revolution of the pressure roller (step S1308). Subsequently, +550 V is applied as a film bias for about 400 msec which corresponds to one revolution of the pressure roller (step S1309). Finally, +600 V is applied as a film bias for about 400 msec which corresponds to one revolution of the pressure roller (step S1310). In this way, the positive value of the film bias gradually increases.

On the other hand, when the absolute humidity is higher than a predetermined value (for example, 0.001 (g/gDA)), the device body is driven (step S1311) and +400 V is applied as a film bias for about 400 msec which corresponds to one revolution of the pressure roller (step S1312). Thereafter, +600 V is applied as a film bias for about 400 msec which corresponds to one revolution of the pressure roller and then the electricity removing operation ends (step S1313). Thereafter, −500 V is applied as a film bias (step S1303) and a sheet is passed (step S1304).

The absolute humidity is checked after a sheet is passed. When the absolute humidity is lower than a predetermined value (for example, 0.001 (g/gDA)) (step S1316), the device body is driven for removal of electricity from the surface layer of the pressure roller (step S1317) and +200 V is applied as a film bias for about 400 msec, which corresponds to one revolution of the pressure roller (step S1318). Thereafter, +300 V is applied as a film bias for about 400 msec, which corresponds to one revolution of the pressure roller (step S1319). Subsequently, +550 V is applied as a film bias for about 400 msec, which corresponds to one revolution of the pressure roller (step S1320). Finally, +600 V is applied as a film bias for about 400 msec, which corresponds to one revolution of the pressure roller (step S1321). In this way, the positive value of the film bias gradually increases.

On the other hand, when the absolute humidity is higher than a predetermined value (for example, 0.001 (g/gDA)) (step S1316), the device body is driven (step S1322) and +500 V is applied as a film bias for about 400 msec, which corresponds to one revolution of the pressure roller (step S1323). Thereafter, +600 V is applied as a film bias for about 400 msec, which corresponds to one revolution of the pressure roller and then the electricity removing operation ends (step S1324). Finally, the final applied polarity of the film bias is maintained at the positive polarity (step S1315) and then the print job ends.

As described above, the initial output value of the plus polarity when the voltage applied to the fixing film 15 is switched from the minus polarity to the plus polarity is controlled so as to be smaller as the absolute humidity becomes lower and then the voltage value of the plus polarity is controlled so as to gradually increase. As a result, it is possible to allow the removal of electricity from the surface layer of the pressure roller to be compatible with the prevention of damage of the fixing film due to electric discharge when a hole is formed in the surface layer of the pressure roller and it is possible to suppress the occurrence of image contamination due to the electrostatic offset and the electric discharge.

In the above-mentioned embodiments, the pressure roller 21 does not include a hole sensing mechanism. Accordingly, it is necessary to perform application control for preventing electric discharge from the initial time of use of a product without depending on whether a hole is formed. However, a hole sensing mechanism that detects a current value flowing in the mandrel of the pressure roller 21 and that senses formation of a hole based on the detected value when a bias is applied to the fixing film, or the like may be provided. In this case, electric discharge does not occur until a hole is formed even when the film bias applied to the fixing film is high. Accordingly, the removal of electricity from the pressure roller 21 may be performed for a short time by applying a high bias before or after a print job and the film bias application control related to the removal of electricity from the pressure roller 21 according to the above-mentioned embodiments may be first performed after it is sensed that a hole is formed.

In the above-mentioned embodiment, it has been described that toner having the negative polarity is used, but the same is true when toner having the positive polarity is used. In this case, since a voltage having the positive polarity is applied to the fixing film 15 for prevention of an electrostatic offset, the surface layer of the pressure roller 21 may be gradually charged to the positive polarity depending on the voltage value. Accordingly, when a recording material is not present in the fixing nip portion 22, it is possible to prevent electric discharge even when a hole is formed in the surface layer of the pressure roller 21, by applying a voltage having the polarity to the fixing film 15 so as to gradually increase the absolute value thereof.

In this embodiment, it has been described that the fixing film 15 having a heat source therein is used as a heating member, but the invention is not limited to this configuration. The same effect can be achieved even when a heating member such as a fixing roller which forms a fixing nip portion in cooperation with the pressure roller is used.

It has been described above that a hole is formed in the surface layer of the pressure roller as a pressurizing member, but the invention is not limited to this configuration. According to this embodiment, it is possible to prevent electric discharge even when a fixing device using a fixing roller or the like as a heating member is used and a hole is formed in an insulating tube covering the surface layer of the fixing roller as the heating member to expose a conductive member under the surface layer.

In this embodiment, as the voltage to be applied for removal of electricity from the surface layer of the pressure roller, the first voltage is applied after a print job and the second voltage is applied before the print job, but the invention is not limited to this configuration. The removal of electricity from the surface layer of the pressure roller may be performed while avoiding electric discharge by changing different voltage values multiple times.

When the power source is turned off for saving energy after a print job ends and the weak electricity removal is not performed, the fact of non-performance thereof may be stored in the RAM 402 of the controller or the like and the weak electricity removal and the main electricity removal may be performed before a next print job based on the stored fact.

In this embodiment, the voltage application unit applies an electricity-removal bias to the fixing film as a heating member, but the invention is not limited to this configuration. A configuration in which an electricity-removal bias is applied to the pressure roller as a pressurizing member to remove electricity from the pressurizing member may be employed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-061674, filed Mar. 25, 2014 which is hereby incorporated by reference herein in its entirety.

What is claimed is:

1. An image forming apparatus which forms an image on a recording material, comprising:

a heating unit which heats the recording material to which a toner image has been transferred;

a pressurizing unit which forms a nip portion between the heating unit and the pressurizing unit, and presses the transported recording material against the heating unit in the nip portion; and a control unit which applies a voltage, with which electric discharge does not occur between the heating unit and the pressurizing unit, to at least one of the heating unit and the pressurizing unit even when a surface layer of the heating unit or the pressurizing unit is in a state in which an inner conductive portion is exposed from the surface layer of the heating unit or the pressurizing unit.

2. The image forming apparatus according to claim 1, wherein the control unit applies the voltage with which electric discharge does not occur when no recording material is present in the nip portion.

3. The image forming apparatus according to claim 1, wherein the control unit applies a first voltage as the voltage with which electric discharge does not occur and then applies a second voltage having the same polarity as the first voltage, whose absolute value is greater than that of the first voltage.

4. The image forming apparatus according to claim 3, wherein the control unit applies the first voltage during a print job ending operation after printing and applies the second voltage during a print job preparation operation before printing.

5. The image forming apparatus according to claim 3, wherein the control unit applies the first voltage and the applies the second voltage in an interval between sheets in a print job.

6. The image forming apparatus according to claim 3, further comprising an environment sensing unit which senses an environmental condition, wherein the control unit determines the value of the first voltage based on the sensing result of the environment sensing unit.

7. The image forming apparatus according to claim 1, wherein the control unit applies, for at least a predetermined period of time, the voltage with which electric discharge does not occur and then applies the voltage with the same polarity as the applied voltage whose absolute value increases.

8. The image forming apparatus according to claim 7, wherein the pressurizing unit is a rotating member, and wherein the predetermined period of time is a period of time corresponding to at least one revolution of the pressurizing unit.

9. An image forming apparatus which forms an image on a recording material, comprising:

a heating unit which heats the recording material to which a toner image has been transferred;

a pressurizing unit which form a nip portion between the heating unit and the pressurizing unit, and presses the transported recording material against the heating unit in the nip portion; and a control unit which applies a voltage, with which electric discharge does not occur between the heating unit and the pressurizing unit, to the heating unit even when a surface layer of the pressurizing unit is in a state in which an inner conductive portion is exposed from the surface layer of the pressurizing unit.

10. The image forming apparatus according to claim 9, wherein the control unit applies the voltage with which electric discharge does not occur when no recording material is present in the nip portion.

11. The image forming apparatus according to claim 1, wherein the control unit applies a first voltage as the voltage with which electric discharge does not occur and then applies a second voltage having the same polarity as the first voltage, whose absolute value is greater than that of the first voltage.

12. The image forming apparatus according to claim 11, wherein the control unit applies the first voltage during a print job ending operation after a print job and applies the second voltage during a print job preparation operation before printing.

13. The image forming apparatus according to claim 11, wherein the control unit applies the first voltage and then applies the second voltage in an interval between sheets in a print job.

14. The image forming apparatus according to claim 11, further comprising an environment sensing unit which senses an environmental condition, wherein the control unit determines the value of the first voltage based on the sensing result of the environment sensing unit.

15. The image forming apparatus according to claim 9, wherein the control unit applies, for at least a predetermined period of time, the voltage with which electric discharge does not occur and then applies the voltage with the same polarity as the applied voltage whose absolute value increases.

16. The image forming apparatus according to claim 15, wherein the pressurizing unit is a rotating member, and wherein the predetermined period of time is a period of time corresponding to at least one revolution of the pressurizing unit.

17. An image forming apparatus which forms an image on a recording material, comprising:

a heating unit which heats the recording material to which a toner image has been transferred;

a pressurizing unit which forms a nip portion between the heating unit and the pressurizing unit, and presses the transported recording material against the heating unit in the nip portion; and a control unit which applies a voltage, with which electric discharge does not occur between the heating unit and the pressurizing unit, to at least one of the heating unit and the pressurizing unit even when a surface layer of one of the heating unit and the pressurizing unit is in a state in which a conductive portion inside the surface layer of the one of the heating unit and the pressurizing unit is electrically conductible with the other one of the heating unit and the pressurizing unit.

18. An image forming apparatus which forms an image on a recording material, comprising:

a heating unit which heats the recording material to which a toner image has been transferred;

a pressurizing unit which forms a nip portion between the heating unit and the pressurizing unit, and presses the transported recording material against the heating unit in the nip portion; and a control unit which applies a voltage, with which electric discharge does not occur between the heating unit and the pressurizing unit, to the heating unit even when a surface layer of the pressurizing unit is in a state in which a conductive portion inside the surface layer of the pressurizing unit is electrically conductible with the heating unit.

* * * * *